United States Patent [19]

Krywiczanin et al.

[11] 4,371,418

[45] Feb. 1, 1983

[54] FEEDING WEB MATERIAL

[75] Inventors: Wladyslaw H. Krywiczanin, Fairoak; William Lumsden, Winchester, both of England

[73] Assignee: British-American Tobacco Company Limited, London, England

[21] Appl. No.: 328,674

[22] Filed: Dec. 8, 1981

[30] Foreign Application Priority Data

Dec. 22, 1980 [GB] United Kingdom ..... 8041062

[51] Int. Cl.[3] ..... B31F 5/06; B65H 19/18

[52] U.S. Cl. ..... 156/497; 156/504; 156/505; 156/541; 156/584; 242/58.4

[58] Field of Search ..... 156/504, 505, 159, 304.3, 156/497, 502, 506, 541, 584; 242/58.4, 58.2

[56] References Cited

U.S. PATENT DOCUMENTS

| | | | |
|---|---|---|---|
| 3,873,393 | 3/1975 | Bruck et al. | 156/505 |
| 3,925,131 | 12/1975 | Krause | 156/505 |
| 4,215,932 | 8/1980 | Castelli et al. | 156/159 |
| 4,278,489 | 7/1981 | Horsley | 156/505 |

FOREIGN PATENT DOCUMENTS

| | | | |
|---|---|---|---|
| 1216310 | 12/1970 | United Kingdom | 242/58.4 |

*Primary Examiner*—Michael G. Wityshyn

*Attorney, Agent, or Firm*—Kane, Dalsimer, Kane, Sullivan and Kurucz

[57] ABSTRACT

Web-splicing apparatus comprises a web splicer and, associated therewith, an air mover and web-presentation means operable to present to the inlet end of the air mover the leading end of a first web extending from a reel and the leading end of a second web extending from another reel, which air mover is operable to feed the leading end of said first web from said presentation means to and through a splicing zone, to serve as a guide for subsequent continuous passage of that web and further operable to feed the leading end of the second said web from said presentation means to said splicing zone during continuous passage of the first web through the air mover. Web-severing means may be disposed for operation in the splicing zone and web-withdrawal means, suitably further air-mover means, downstream of that zone. Splicing-patch supply means comprises a continuous backing strip carrying spaced adhesive patches, means for advancing the said strip past patch-detachment means, a movable vacuum-supplied holding element for receiving detached said patches, and a vacuum-supplied stationary element on the side of the web path remote from said movable element, a detached patch being pressable onto a web by movement of the first-named element towards the second-named element.

5 Claims, 6 Drawing Figures

FEEDING WEB MATERIAL

Figure 1:
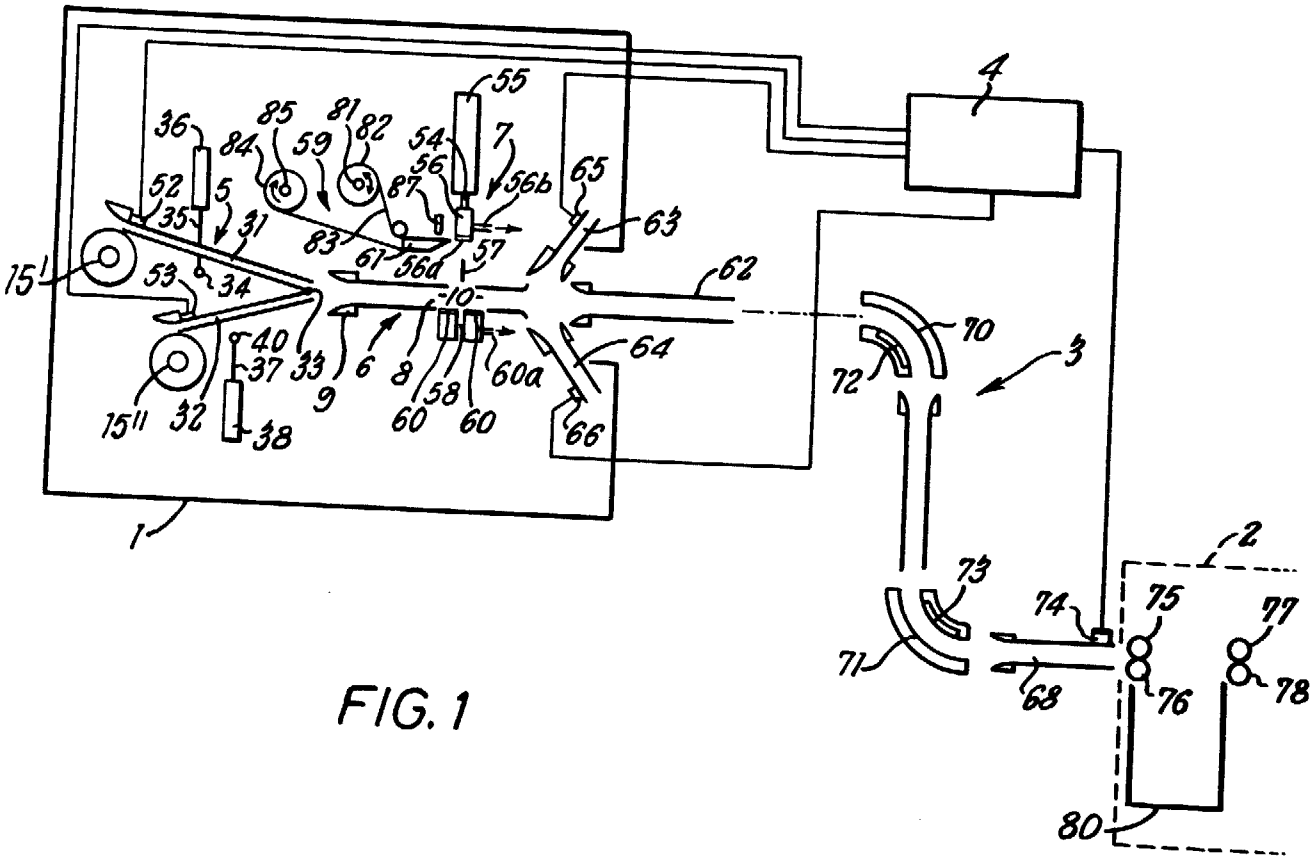

This invention relates to the feeding of web material to, for example, web utilising machinery.

Machines of numerous types have a requirement for the supply of materials in continuous web form. For example cigarette-making machines, cigarette-filter making machines and cigarette-packing machines require to be fed with continuous webs of materials such as cigarette paper, filter-plugwrap paper, metallic foil and plastics-film material. It is usual in the case of such tobacco-industry machinery for reels of the materials to be mounted on the respective machines.

In the current search for higher rates of machine productivity, various expedients have been proposed for reducing the necessity for, or frequency of, intervention by the machine operator. One reason for operator intervention is the replenishment of expiring reels of web materials. It has heretofore been necessary in the case of tobacco-industry machines for a machine operator to carry out manual procedures in connection with each replacement of an expiring reel by a fresh reel and the splicing operation between the old and new webs. Similar manual procedures have had to be carried out upon the occurrence of a web breakage.

It is an object of the present invention to provide a web supply apparatus, including web-splicing apparatus, which requires reduced operator intervention, possibly only a recharging of a store with a supply of fresh reels once per shift or per day and which contributes to a storage and feed system in which a continuous web can be fed to a web utilising machine from a position remote from the machine.

According to the invention, web-splicing apparatus comprises a web-splicer, an air mover and associated presentation means operable to present to the inlet end of the air mover the leading end of a first web extending from a first reel thereof and the leading end of a second web extending from a second reel thereof, said air mover being operable to feed the leading end of said first web from said presentation means to and through the splicing zone of said splicer and being adapted to serve as a guide for continuous subsequent passage of the first web and being further operable to feed the leading end of the said second web from said presentation means to said splicing zone during the continuous passage of said first web through the air mover.

There may be disposed at the downstream side of the splicing zone withdrawal means operable, when that portion of the second web downstream of the splicing zone is severed from the remainder of the second web during the splicing operation, to withdraw the said portion for disposal thereof. It is necessary that the web splicing apparatus can operate in such fashion that the web extending from the second reel passes continuously through the air mover and the web extending from the first reel is the fresh web to be spliced to the continuously running web and advantageously there is provided second withdrawal means disposed to that side of the path of the spliced web opposite that at which the first mentioned withdrawal means is disposed. Suitably the withdrawal means, is, or are, an air mover or movers.

The leading end of the new web can initially be fed through the splicing zone and into a withdrawal means, but advantageously it can be fed to and maintained at the presentation means. The merit of this alternative arrangement is that should a breakage occur in the running web, and should the reel from which the running web extends have reached a predetermined minimum radius, then after the portion of the web extending from that reel has been rewound so as to withdraw the end thereof from the air mover, the leading end of the new web can be fed through the air mover and forwardly therefrom to the web utilising machine.

Web-splicing apparatus according to the present invention can be used with particular advantage in conjunction with web-supplying apparatus set forth and claimed in our co-pending United States Patent Application of even date and/or in conjunction with web-end capture apparatus set forth and claimed in another of our co-pending U.S. applications of even date, for both of which Applications we have claimed the same priority of date (22.12. 80, British Patent Application No. 80.41062) as has been claimed for the present application.

Figure 2:
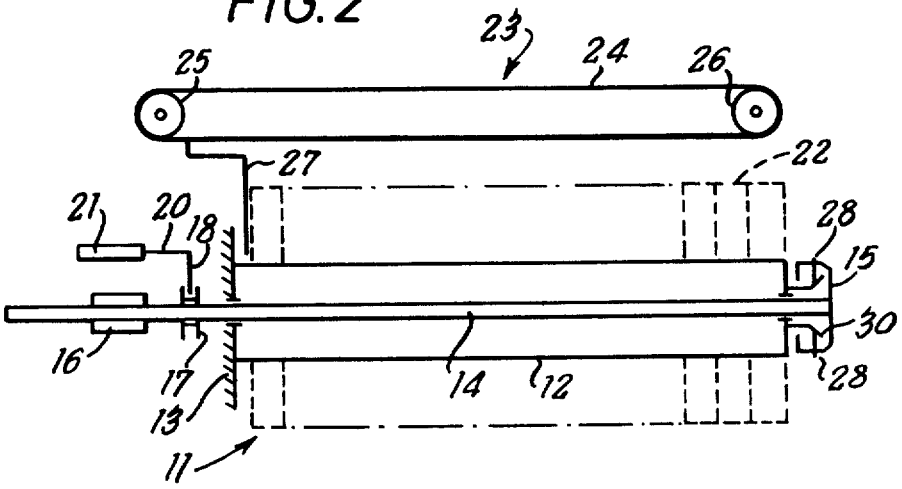
Figure 6:
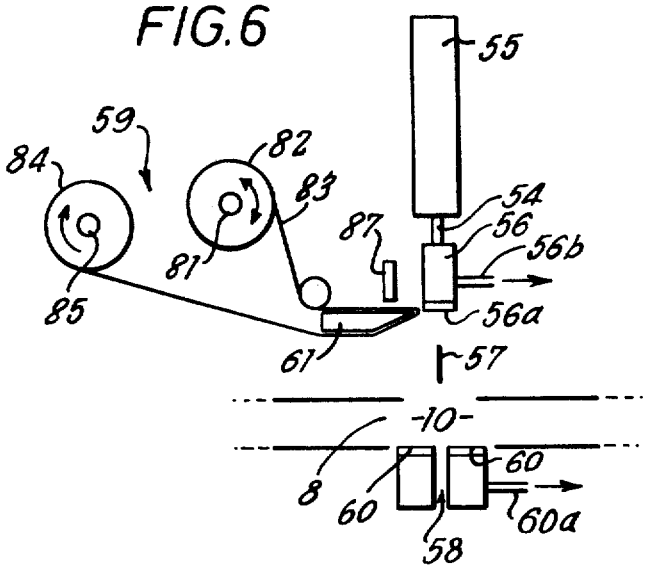
Figure 3:
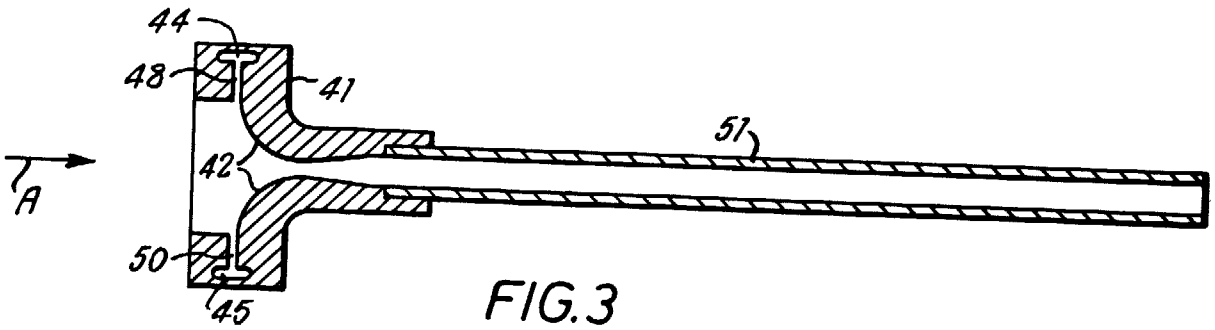
Figure 4:
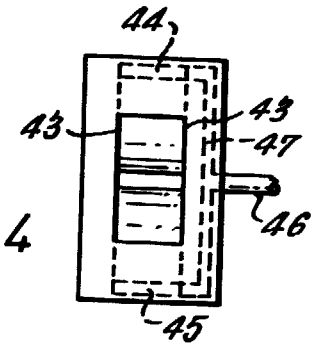
Figure 5:
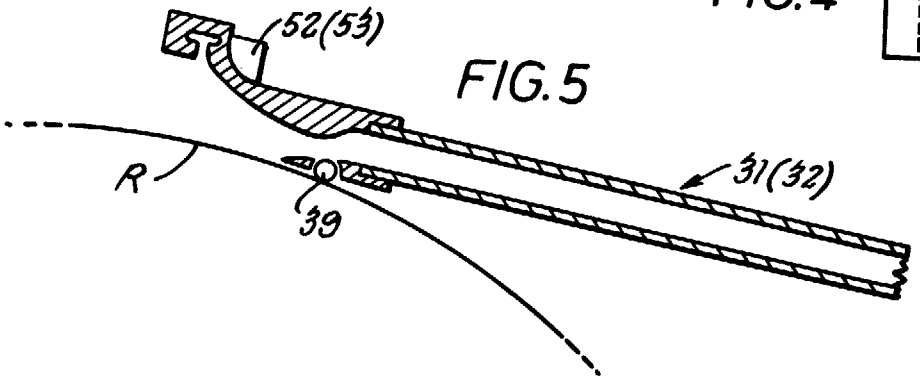

In order that the present invention may be clearly understood and readily carried into effect, reference will now be made by way of example to the accompanying diagrammatic drawings, in which:

FIG. 1 shows an automatic apparatus for supplying web material to a web-utilising machine from a remote location, FIG. 2 is an elevation to a larger scale of a reel storage and advancing unit of the apparatus of FIG. 1, FIG. 3 is a sectional elevation of an air mover, again to a larger scale, FIG. 4 is an end view of the air mover of FIG. 3 as seen in the direction of the arrow A, FIG. 5 is a view similar to FIG. 3 of an air mover having a modified form of inlet, and FIG. 6 is an elevational view to a larger scale of a splicer unit used with the apparatus of FIG. 1.

The apparatus shown in FIG. 1 comprises a reel changer generally designated 1, a web-utilising machine 2, such as a cigarette maker or cigarette-filter maker, a pneumatic web-transport system generally designated 3 and electronic control means 4, which may be a microprocessor. The reel changer 1 includes a reel store 5 and a splicer unit 6 comprising a splicer 7 and an air mover 8 extending to each side of the splicing zone 10.

The reel store 5 comprises two reel storage and advancing units one mounted above the other. One such unit 11 illustrated in FIG. 2 comprises a hollow mandrel 12 mounted at one end thereof on fixed wall means 13 and extending horizontally therefrom. A shaft 14 extending axially through the mandrel 12 is mounted for rotational and axial movement relative thereto. Keyed to the shaft 14 at one end is a reel-holding drum 15. Respective drums 15', 15'' of the aforesaid two units 11 are shown in FIG. 1. Splined on the shaft 14 (FIG. 2) is a drive sleeve 16 of known design which accommodates the axial movement of the shaft. The shaft 14 is rotatable via the sleeve 16 by a reversible motor (not shown). Adjacent the sleeve 16, a grooved collar 17 is fixedly secured to the shaft 14. An arm 18 extending into the groove of the collar 17 is provided on the outer end of a piston rod 20 of a pneumatic piston and cylinder 21. Thus the shaft 14 can be moved to and fro axially in relation to the mandrel 12.

On the mandrel 12 there may be supported a number of reels of web material, as indicated by broken line 22. The unit 11 further comprises reel-advancing means 23 in the form of an endless chain 24 running around sprockets 25, 26 one of which is drivable by a reversible motor (not shown). The chain 24 carries a cranked pusher arm 27. The drum 15 is provided with reel-engaging dogs 28 (only two of which are shown in FIG. 2), which extend through openings in the peripheral wall of the drum. The dogs are urged radially inwardly by resilient means (not shown) and their inner ends contact an inclined cam surface 30 fixed to the mandrel 12.

Assuming that, at the beginning of a proposed period of operation of the machine 2, a batch of reels 22, sufficient to meet the web requirement of that period has been placed upon the mandrel 12, the subsequent automatic operation of the unit 11 is as follows. By the action of the piston rod 20, the shaft 14 is moved axially to the left (in FIG. 2) until the drum 15 is almost in abutment with the end of the mandrel 12. The inner ends of the inwardly urged dogs 28 descend the cam surface 30 and thus their outer, reel engaging, ends are retracted to a position in which they no longer project from the peripheral surface of the drum 15. The drive motor is then activated to rotate the sprocket 25 in a counter-clockwise direction and move the pusher arm 27 towards the right. The batch of reels 22 is moved until the reel most remote from the arm 27 is fully located on the drum 15, at which time the aforesaid drive motor is stopped. Next the piston rod 20 is activated to move the shaft 14 and drum 15 towards the right until the drum has been returned to its initial, reel-unwinding, location. This movement separates the reel carried by the drum 15 from its neighbour in the batch carried on the mandrel 12 and also results in the dogs 28 being moved to and held in their reel-engaging positions. Thus, when the shaft 14 is subsequently rotated, in either direction, via the sleeve 16, the reel on the drum 15 is also rotated.

In FIG. 1, in addition to the reel-holding drums of the two storage and advancing units 11 of the reel store 5, designated 15' and 15'', the store 5 further comprises air movers 31, 32 associated with respective upper and lower units 11. The air movers 31, 32 are pivoted at their outlet ends at a common pivot point 33 and are arranged to rest at their inlet ends substantially tangentially at an upper part of the periphery of respective reels on the drums 15', 15''. By means of a lifting pin 34 carried at the lower end of a piston rod 35 extending from a cylinder 36, the air mover 31 can be pivoted upwardly to a position in which it is clear of the path of a fresh reel during advancement thereof to the drum 15'. Similarly, the air mover 32 can be pivoted to a reel-clearing position by a pin 40 carried by the upper end of a piston rod 37 extending from a cylinder 38.

Air movers are known devices for transporting webs. They are especially useful for transporting web material of a flimsy nature. An air mover illustrated diagrammatically in FIGS. 3 and 4 comprises an inlet block 41 through which extends an open-ended convergent divergent passageway of rectangular cross-section defined by surfaces of upper and lower curved walls 42 (FIG. 3) and side walls 43 (FIG. 4). Also within the block are upper and lower plenum chambers 44, 45 to which air under pressure can be supplied, from a source not shown, through a pipe 46 communicating with a passage 47 in the block 41. Outlet slits 48, 50 extending across the full width of the surfaces 42 lead from the chambers 44, 45 to respective surfaces 42. Mounted in the block 41 is a length of ducting 51, of rectangular internal cross-section, which forms a continuation of the outlet end of the passageway defined by the walls 42, 43. In operation of the air mover, air issuing from the slits 48, 50 attaches itself to the curved walls 42. This results in the entrainment of ambient air and if the leading end of a web is presented to the passageway in the block 41 it will be caused to pass, with the air, through the passageway and the ducting 51.

As illustrated in FIG. 5, the air movers 31, 32 of the reel store 5 have inlet ends formed with what is in effect only the upper half of the block 41 of the air mover shown in FIGS. 3 and 4. As will be seen from FIG. 5, the passageway of the modified inlet end is partly defined by the peripheral surface of the reel R. A freely rotating roller 39 which rests on the reel R is provided at the inlet end. This form of end serves to lift the web end from the periphery of the reel R when the latter is rotated in a direction contra to the unwinding direction, i.e. in a counter clockwise direction in FIGS. 1 and 5. The air movers 31, 32 are provided at their inlet ends with sensors 52, 53 operable to sense the capture of a web end.

The splicer 7 of the splicer unit 6 comprises a piston rod 54 and cylinder 55. The lower end of the piston rod 54 carries a rectilinear block 56 to the resilient lower face **56*a* of which vacuum supplied at 56*b* can be applied. The splicer 7 also comprises a knife 57 with known knife-control cam mechanism which, for the sake of clarity, is not shown. The knife-control mechanism is so operatively connected to the rod 54 that downward movement of the latter causes the knife 57 to be moved downwardly through the splicing zone 10. After the knife has passed through the zone 10, the control mechanism causes the knife 57 to be swung to a position clear of that zone, for return upward movement, after completion of which the mechanism causes the knife to be swung back to its initial position. Fixedly mounted at a location below the block 56 is a block 58 having a narrow opening for the passage of the knife 57 and an upper resilient surface 60 at which vacuum supplied at 58*a* can be applied. Vacuum means (not shown) activatable upon receipt of command signals from the control means 4 is operable to apply controlled application of vacuum at the surface 56*a* and at the surface 60 by way of ports or openings (not shown) at the respective surfaces, as hereinafter described. The splicer 7 also comprises patch-supply means 59 (FIG. 6), operable to feed about a nose 61 a backing strip 83, carrying spaced-apart adhesive patches, so that patches are presented one at a time to the lower face 56*a* of the block 56 in its illustrated uppermost position level with the horiziontal upper surface of the nose 61**.

Openings are provided in the air mover 8 of the unit 6 of sufficient width to permit movement therethrough of the block 56 and knife 57. The air mover has an inlet end block 9 of a form generally similar to that of the air mover described with reference to FIGS. 3 and 4. As may be seen from FIG. 1, the block 9 is located closely adjacent the outlet ends of the air movers 31, 32. Thus when a web is presented, by either of the air movers 31, 32, at the inlet end of the air mover 8, the web end is readily entrained by the air flow through the air mover 8. Consequently webs can be fed from either the upper or the lower storage unit 11 to or through the splicing zone 10. Near the outlet end of the air mover 8 there is disposed the inlet end of an air mover 62 which is axially aligned with the air mover 8 and forms an upstream part of the air-transport system 3. Above and below the inlet end of the air mover 62 are located the inlet ends of further air movers 63, 64 providing respective web-withdrawal means. The arrangement is such that the leading end of a web passing from the splicing zone 10 can be entrained by the air moving through the air mover 62 and thus be threaded into the web-transport system 3 for conveyance to the utilising machine 2. If, however, instead of being supplied to the inlet end of the air mover 62, compressed air is supplied to the inlet end of one of the air movers 63, 64, then the leading end of the web will enter that air mover and the web will be diverted from the normal feed path. Associated with the air movers 63, 64 are sensors 65, 66 operable to sense web presence in the respective said air movers.

The apex of the nose 61 of the patch-supply means 59 is disposed close to the lower face 56*a* of the block 56. From a reel 82 on a braked spool 81, the continuous backing strip 83 carrying the spaced-apart adhesive patches is trained about the nose 61 and extends therefrom to a reel 84 mounted on a take-up spool 85 rotatable in the direction indicated by the arrow by drive means (not shown). When a portion of the strip 83 carrying a patch is pulled around the apex of the nose 61, the backing strip becomes peeled away from the patch and the latter is received on the lower face of the block 56 and is held there by the vacuum applied. Upon completion of the transfer of a patch to the block 56, the supply of vacuum to the latter is discontinued in response to a signal from a sensor 87 operable to detect leading edges of patches on the strip 83.

The web-transport system 3, only parts of which are shown in FIG. 1, comprises a plurality of air movers, some of which, 62, 67, 68, are shown. The web path defined by the system 3 may be 10 m or more in length and may include curves or bends, even right-angle bends. Curves or bends are defined by air bearing units, illustrated by units 70, 71, having plenum chambers 72, 73 to which compressed air can be supplied from a source (not shown) and from which ports open at the inner surfaces of the bends. As will be known to those skilled in the art, means whereby the web path can be turned in a plane other than that of the drawing of FIG. 1 may readily be provided.

Associated with the outlet end of the air mover 68 which defines the outlet end of the web path of the system 3, is a sensor 74 operable to sense the absence of a web at the said outlet end, which is positioned for feeding a web between a pair of co-operating, drivable feed rollers 75, 76 of the machine 2. From the rollers 75, 76, the web passes to a further pair of drivable rollers 77, 78 of the machine. The rollers 75, 76 may be driven at either substantially the same speed of rotation as the rollers 77, 78 or at a higher speed. In the latter case, as is well known in the cigarette and filter-making arts, a buffer-stock length of the web will be formed intermediate the rollers 75, 76 and the rollers 77, 78. A box 80 is provided to receive and contain the buffer stock.

The manner of operation of the web-supply system generally depicted in FIG. 1 will now be described.

It will be assumed that a condition obtains in which there is no web material in the utilising machine 2 or in either of the air movers 31, 32. Upon a manual initiation signal being given to the electronic control means 4, the latter initiates an operation of the upper reel storage and advancement unit 11 in order to bring a fresh reel into a reel unwinding location on the drum 15' of that unit, at which time the air mover 31 is held, by the lifting means 34, 35, 36, clear of the reel advancing to the drum. Under command of the control means 4, the drum 15' and the reel mounted thereon are caused to rotate slowly in the contra direction and the inlet end of the air mover 31 is lowered onto the periphery of the reel. When the leading end of the web is captured at the said inlet end, this condition is sensed by the sensor 52 (FIG. 5). Upon receiving a capture signal from the sensor 52, the control means 4 causes the drum 15' to cease rotation in the contra direction and to commence rotation in the unwinding direction, thus permitting the leading edge of the web to be fed through to the outlet end of the air mover 31. The control means 4 also causes conveying air to be supplied to the air-mover 8 and the air movers of the web-transport system 3. The web, upon issuing from the outlet end of the air mover 31, enters the air mover 8, passes through the splicing zone 10 to the outlet end of the air mover 8, enters the first air mover 62 of the system 3 and passes through the remaining length of that system to the machine 2. At the machine 2, the web is presented to the feed rollers 75, 76, this condition being signalled to the control means 4 by the sensor 74 or by a sensor (not shown) on the machine 2. By action of the control means 4, the drive to the drum 15' is terminated, the supply of conveying air to the air movers 31 and 8 and to those of the system 3 is discontinued and the air supply to air bearings 70, 71 is commenced. The air movers then act as web-guide means only, the web being drawn from the reel by the feed rollers 75, 76 of the machine 2.

The control means 4 will, when necessary, also initiate operation of the lower reel storage and advancing unit 11 to advance a fresh reel to the drum 15" thereof, the air mover 32 being held in its reel-clearing position by the lifting unit 37, 38, 40. When the fresh reel has reached the reel-unwinding location on the drum 15", the inlet end of the air mover 32 is lowered onto the periphery of the reel. The drum 15" is caused to rotate slowly in the contra direction until capture of the web leading end is sensed by the sensor 53, whereupon the drum 15" is caused to rotate in the unwinding direction until the leading end of the web has advanced to a location at or just upstream of the outlet end of the air mover 32. The leading end of the web is then brought to rest by discontinuance of the drive of the drum 15" brought about in response to a timing signal developed within the control means 4 or in response to web-sensing means (not shown) located at the outlet end of the air mover 32. The lower, stationary, web is thus available for feeding forwardly to the machine 2 if the upper, running, web breaks at a location upstream of the sensor 74 and the upper reel has reached the predetermined minimum radius, which latter condition is determined by sensing means (not shown) connected to the control means 4. This sensing means may be so associated with the air mover 31 as to indicate the position thereof. Alternatively, as the reel from which the running web extends approaches exhaustion, a condition which may be indicated by the last mentioned or an additional sensing means connected to the control means 4, a signal from the control means 4 causes initiation of the supply of air to the air movers 31, 8 and 64 and another signal from the control means 4 initiates rotation, in the unwinding direction, of the drum 15" of the lower unit 11. The end of the web extending from the reel on the drum 15" is thus fed from the air mover 32 through the air mover 8 and into the air mover 64. The capture of the web by the air mover 64 is sensed by the sensor 66 which then sends a signal to the control means 4, upon receipt of which the latter causes discontinuance of the air supply to the air mover 64 and also of the drive to drum 15". The control means 4 then initiates and controls a splicing sequence as follows.

The rollers 75, 76 of the machine 2 are speeded up to cause a buffer stock of web to build up in box 80. During this build-up, an adhesive patch is fed by the patch-supply means 59 to the block 56 in its uppermost position as shown and is held on the lower face 56a of that block by the action of the vacuum therein. Also during the web build-up, vacuum application to the upper face 60 of the block 58 is commenced. At completion of the build-up the drive to the rollers 75, 76 is discontinued. The piston rod 54, then moves the block 56 downwardly. By action of the knife-control mechanism, the knife 57 descends and severs both the upper and lower webs extending through the splicing zone 10. Before the adhesive patch carried on the block face 56a enters the splicing zone, the drum 15' of the upper unit 11 is caused to rotate in the contra direction to withdraw that portion of the upper web which extends from the expired reel to the splicing zone. The adhesive patch is moved downwardly into the splicing zone and brought into contact with the trailing edge of the upper web and the leading edge of the fresh web. The splice thus formed is subjected to pressure as the lower resilient face 56a of the block 56 is pressed into contact with the resilient upper surface 60 of the block 58. The application of vacuum at the surfaces 56a, 60 is then discontinued, following which the air mover 64 is activated to withdraw the foremost portion of the lower web from the splicing zone 10. The drive to the feed rollers 75, 76 of the machine 2 is recommenced.

At the next splicing operation, there will be in the air mover 8 a stationary web length extending from a fresh reel held on the drum 15' of the upper unit 11 and, beneath that stationary length, a continuous length of web being unwound from a nearly expired reel held on the drum 15" of the lower unit 11. The splicing sequence is as described above except that the upstream portion of the fresh web is removed by the air mover 63 after severance by the knife 57, but before application of an adhesive patch.

After a splicing operation has taken place, whether the fresh reel is on the drum 15' or the drum 15", and after the portion of the web extending from the expired reel has been rewound onto the reel, in response to a signal from the control means 4 the expired reel will be pushed from the drum 15' or 15" on which it is mounted by the advancement of the next fresh reel on to that drum.

Although the buffer stock has been described as being built up on the machine 2, means providing buffer stock may be disposed clearly downstream of the splicer unit 6.

If a web running to the machine 2 breaks at a location intermediate the sensor 52 or 53 past which the web is running and the sensor 74, the portion of the web downstream of the breakage will be advanced out of the system 3 by the action of the driven rollers 77, 78 of the machine. The absence of web at the exit of the system 3 is then sensed by the sensor 74, which sends a web-absence signal to the control means 4. Upon receipt of this signal, the control means ascertains whether or not the running reel has been reduced to the predetermined minimum radius. If the minimum radius has not been reached the control means 4 causes the air supply to the air bearings 70, 71 to be discontinued, air supply to the air movers to be re-established, and the drum 15' or 15" on which the reel in question is mounted to be rotated in the web-unwinding direction in order to re-thread the web into the machine 2. When this has been accomplished, the sensor 74 senses the presence of the web at the exit of the system 3. This results in discontinuance of the air supply to the air movers and re-establishment of the air supply to the air bearings 70, 71. If, however, the reel has reached the predetermined minimum radius when the breakage occurs, the drum is rotated in the contra direction to rewind onto the reel the portion of the web extending therefrom to the breakage location. Thereafter the other drum, on which the fresh reel is mounted, is rotated in the unwinding direction to permit the threading of a new web into the machine 2.

If the breakage in a running web occurs at the reel, this will be detected by the sensor 52 or 53 associated with the web. The control means 4 will in this case cause the reel to be rotated in the contra direction. If the web end is recaptured by the associated air mover 31 or 32, the reel will be rotated in the unwinding direction to permit re-threading of the web into the machine 2. If recapture does not occur within a predetermined period of time, a fresh web will be fed forwardly from the reel on the other drum and the first mentioned reel will be replaced by a fresh reel.

Web sensors additional to sensor 74 can with advantage be associated with the transport system 3. For example, a web sensor may be associated with each air mover in the system. Additional sensors make possible the attainment of a shorter time of response to web breakage or breakout in the system.

The reel storage and advancement means could take a form other than that of the units 11 described with reference to FIG. 2. The said means could be of a type in which reels are supported otherwise than by support means extending through openings in reel bobbins, so that fresh reels can be added to the depleted store at any time.

What is claimed is:

1. Web-splicing apparatus comprising a web splicer and, associated therewith, an air mover and web-presentation means operable to present to the inlet end of the air mover the leading end of a first web extending from a reel and the leading end of a second web extending from another reel, which air mover is operable to feed the leading end of said first web from said presentation means to and in a path through a splicing zone of the said splicer, to serve as a guide for subsequent continuous passage of that web, and further operable to feed the leading end of the second said web from said presentation means to said splicing zone during continuous passage of the first web through the air mover.

2. Apparatus according to claim 1 and further comprising web-severing means disposed for operation in said splicing zone.

3. Apparatus according to claim 1 or 2 and further comprising web-withdrawal means disposed downstream of the splicing zone.

4. Apparatus according to claim 1 or 2 and further comprising web-withdrawal means including at least one air mover additional to the aforesaid air mover with which the presentation means is associated.

5. Apparatus according to claim 1 or 2 and further comprising splicing-patch supply means including a continuous backing strip for carrying spaced-apart adhesive patches, means for advancing the backing strip past patch-detachment means, a movable holding element for receiving detached said patches, a stationary element located on the side of the web path remote from said movable element, and provision for the supply of vacuum to the said movable and stationary elements, whereby a detached patch is pressable onto a web by movement of said first-named element towards said second-named element.

* * * * *